United States Patent [19]

Bissot et al.

[11] Patent Number: 4,477,321

[45] Date of Patent: Oct. 16, 1984

[54] SACRIFICIAL REINFORCEMENTS IN CATION EXCHANGE MEMBRANE

[75] Inventors: Thomas C. Bissot, Newark, Del.; Raimund H. Silva, Winsen, Fed. Rep. of Germany

[73] Assignee: E. I. Du Pont de Nemours and Company, Wilmington, Del.

[21] Appl. No.: 339,467

[22] Filed: Jan. 15, 1982

Related U.S. Application Data

[63] Continuation-in-part of Ser. No. 225,651, Jan. 16, 1981, abandoned.

[51] Int. Cl.[3] ..... C25B 1/34; C25B 1/02; C25B 13/02; C25B 13/08

[52] U.S. Cl. ..... 204/98; 204/128; 204/252; 204/258; 204/283; 204/296; 204/129

[58] Field of Search ..... 204/98, 128, 296, 283, 204/252–258, 129

[56] References Cited

U.S. PATENT DOCUMENTS

| | | | |
|---|---|---|---|
| 3,242,059 | 3/1966 | Cottam et al. | 204/98 |
| 3,940,916 | 3/1976 | Grot | 57/140 R |
| 4,021,327 | 5/1977 | Grot | 204/296 |
| 4,100,050 | 7/1978 | Cook et al. | 204/296 |
| 4,123,336 | 10/1978 | Seko et al. | 204/296 |
| 4,124,477 | 11/1978 | Tokawa et al. | 204/296 |
| 4,135,996 | 1/1979 | Bouy et al. | 204/98 |
| 4,191,618 | 3/1980 | Coker et al. | 204/128 |
| 4,272,337 | 6/1981 | Darlington | 204/98 |

FOREIGN PATENT DOCUMENTS

| | | | |
|---|---|---|---|
| 2040222 | 8/1980 | United Kingdom | 57/140 R |

*Primary Examiner*—R. L. Andrews

[57] ABSTRACT

A fluorocarbon cation exchange membrane containing a sacrificial reinforcement for tear resistance which, in use as a cation exchange membrane for alkali metal chloride electrolysis, degrades to provide low voltage operation of the electrolytic cell.

16 Claims, No Drawings

SACRIFICIAL REINFORCEMENTS IN CATION EXCHANGE MEMBRANE

CROSS-REFERENCE TO RELATED APPLICATION

This is a continuation-in-part of copending application Ser. No. 225,651, filed Jan. 16, 1981 now abandoned.

BACKGROUND OF THE INVENTION

Fluorinated polymers containing pendant side chains having functional groups are used as ion exchange membranes for electrochemical cells, particularly as membranes in chloralkali electrolytic cells. Typically, the side chains on the fluorinated polymers contain sulfonyl or carboxyl groups or both. In the use of such membranes in electrolytic cells, the desired performance characteristics are obtained using a particularly thin membrane. It is desirable to minimize the thickness of this membrane, to reduce the operating voltage of the electrolytic cell. However, the thin membranes are difficult to handle without damage or tearing during installation in the electrolytic cells. Accordingly, the thin membranes are frequently reinforced with woven or nonwoven webs. However, such reinforcing webs, in the operation of an electrolytic cell, cause uneven current distribution and increased operating voltage.

SUMMARY OF THE INVENTION

The instant invention provides an improved reinforced fluorinated polymer membrane which exhibits adequate strength for normal installation procedures without increasing the operating voltage of the cell.

Specifically, the instant invention provides, in a fluorocarbon cation exchange membrane of at least one fluorinated polymer having side chains containing sulfonyl and/or carboxyl groups, the improvement which comprises a reinforcing web embedded in the fluorinated polymer which is degraded by hypochlorite.

DETAILED DESCRIPTION OF THE INVENTION

The fluorocarbon cation exchange membranes which can be used in the instant invention have side chains containing either or both sulfonyl and carboxyl groups.

Polymers having sulfonyl functional groups typically contain pendant side chains having $$-CF_2-\underset{\underset{R_f}{|}}{CF}-SO_2F$$

groups wherein $R_f$ is F, Cl, or a $C_1$ to $C_{10}$ perfluoralkyl radical, and preferably F. Ordinarily, the functional group in the side chains of the polymer will be present in terminal $$-O-CF_2-\underset{\underset{R_f}{|}}{CF}-SO_2F$$

groups. Fluorinated polymers of this kind and their preparation are disclosed in U.S. Pat. Nos. 3,282,875, 3,560,568, 3,718,627 and 3,041,317, hereby incorporated by reference. Perfluorinated polymers are preferred because of their inertness to a wide variety of chemicals.

The equivalent weight of these polymers is generally about from 1000 to 1600.

The fluorinated polymers having carboxyl functional groups are typically polymers having a fluorinated hydrocarbon backbone chain to which are attached the functional groups or pendant side chains which in turn carry the functional groups. Fluorinated polymers of this kind and their preparation are disclosed in British Pat. No. 1,145,445, U.S. Pat. Nos. 3,506,635, 4,116,888 and 3,852,326, all hereby incorporated by reference. Preferred monomers for use in the preparation of such polymers are found in U.S. Pat. Nos. 4,121,740 and 3,852,326, also hereby incorporated by reference. For chlor-alkali cells, perfluorinated polymers are preferred.

Polymers are preferred in which the carbon atom adjacent to the carboxyl group bears one, and especially two, fluorine atoms. Also preferred are perfluorinated polymers. The equivalent weight of the polymers having carboxyl functional groups is preferably about from 500 to 1500.

The membranes used in the instant invention comprise single layers of polymers having sulfonyl or carboxylic functional groups, single layers of polymer containing both types of functional groups, as well as laminar structures containing different polymers or different equivalent weights of similar polymers. Such laminar structures are preferred.

The central feature of the present invention is a reinforcing web embedded in the fluorinated polymer which is degraded by hypochlorite. Thus, the reinforcing web provides added strength for the membrane during manufacturing operations and the installation of the membrane in an electrolytic cell, but, because of its degradability in hypochlorite, is disintegrated in operation. The oxidation of the reinforcing web to low molecular weight products results in its removal from the membrane. The disintegration of the reinforcing web eliminates the areas in the membrane that typically cause higher operating voltages. These deficiencies were noted with the use of reinforcing polymers such as polytetrafluoroethylene which are resistant to degradation.

A wide variety of reinforcing webs can be used in the present invention. These include woven and knitted fabrics as well as nonwoven felts and papers and randomly dispersed fibrils. The particular composition of the reinforcing web can also vary widely, including most natural and synthetic fibers. Representative of reinforcing fibers that can be used are those of cotton, linen, silk, rayon, acetate, nitrocellulose, nylon, polyester, polyvinyl alcohol, polyacrylonitriles, polyolefins and cellulose. Of the nonwoven materials which can be used in the present invention, lightweight tissue paper has been found particularly satisfactory. Among the woven fabrics which can be used, a low denier rayon is particularly preferred.

An important factor in the present invention is that the reinforcing web be embedded in the fluorinated polymer. That is, the reinforcing web must not be present throughout the entire thickness of the cation exchange membrane, since this would produce passages through the entire thickness of the membrane after the reinforcing web was degraded and removed. Preferably, the reinforcing web is completely encapsulated in the fluorinated polymer. In the event that a laminar structure is used as the fluorocarbon cation exchange membrane, such as one containing a first fluorinated polymer having sulfonic groups and a second fluorinated polymer having carboxylic acid groups, the reinforcing web is preferably embedded in the fluorinated polymer having sulfonic acid groups in the pendant side chains.

The thickness of the reinforcing web can vary with the total thickness of the fluorocarbon cation exchange membrane. However, in general, the reinforcing web has a thickness of about from 1 to 5 mil (25 to 127 micron) and preferably of about from 2 to 4 mil (50 to 101 micron).

The cation exchange membranes of the present invention exhibit increased structural integrity and are resistant to tears often encountered in the installation of such membranes in an electrolytic cell. This structural integrity is achieved without the presence of permanent reinforcing materials such as perfluorinated polymer webs. However, after a period of operation in an electrolytic cell, the reinforcing web is degraded so as to not interfere with the electrical conduction of the membrane. In fact, the voids remaining after disintegration of the reinforcing web actually aid in electrical conduction, thereby further reducing the voltage requirements of the operating cell. The period for degradation of the reinforcing web will, of course, vary with the particular material selected, the thickness of the reinforcing web and the operating conditions of the cell. In general, however, the period of degradation will vary from several hours to up to two months.

The membranes of this invention can be used in any known membrane electrochemical cell, especially cells for the electrolysis of brine. Among these cells are those in which the gap or spacing between the electrodes is no greater than about 3 mm. The membrane can be held in contact with either the anode or the cathode with the aid of a hydraulic head in one cell compartment, or with an open-mesh or grid or woven spacer to urge the membrane against the electrode. It is often advantageous for the membrane to be in contact with both porous anode and porous cathode in narrow-gap cells of this type. Such arrangements minimize the resistance contributed by the anolyte and catholyte, thus providing for operation at low voltage. The membranes of this invention can also be used in a solid polymer electrolyte or composite electrode/membrane arrangement, in which a thin porous anode and/or porous cathode are attached directly to the membrane surface, and rigid current collectors can also be used in contact with these electrodes.

In any of the above arrangements, either or both of the electrodes can have a catalytically active surface layer of the type known in the art for lowering the overvoltage at an electrode. Such electrocatalyst can be of a type known in the art, such as those described in U.S. Pat. Nos. 4,224,121 and 3,134,697, and published UK patent application GB No. 2,009,788A. Preferred cathodic electrocatalysts include platinum black, Raney nickel and ruthenium black. Preferred anodic electrocatalysts include platinum black and mixed ruthenium and iridium oxides.

The membranes described herein can also be modified on either surface or both surfaces thereof so as to have enhanced gas release properties, for example by providing optimum surface roughness or smoothness, or, preferably, by providing thereon a gas- and liquid-permeable porous non-electrode layer. Such non-electrode layer can be in the form of a thin hydrophilic coating or spacer and is ordinarily of an inert electroinactive or non-electrocatalytic substance. Such non-electrode layer should have a porosity of 10 to 99%, preferably 30 to 70%, and an average pore diameter of 0.01 to 2000 microns, preferably 0.1 to 1000 microns, and a thickness generally in the range of 0.1 to 500 microns, preferably 1 to 300 microns. A non-electrode layer ordinarily comprises an inorganic component and a binder; the inorganic component can be of a type as set forth in published UK patent application GB No. 2,064,586A, preferably tin oxide, titanium oxide, zirconium oxide, or an iron oxide such as $Fe_2O_3$ or $Fe_3O_4$. Other information regarding non-electrode layers on ion-exchange membranes is found in published European patent application No. 0,031,660, and in Japanese Published patent applications Nos. 56-108888 and 56-112487.

The binder component in a non-electrode layer, and in an electrocatalyst composition layer, can be, for example, polytetrafluoroethylene, a fluorocarbon polymer at least the surface of which is hydrophilic by virtue of treatment with ionizing radiation in air or a modifying agent to introduce functional groups such as —COOH or —$SO_3H$ (as described in published UK patent application GB No. 2,060,703A) or treatment with an agent such as sodium in liquid ammonia, a functionally substituted fluorocarbon polymer or copolymer which has carboxylate or sulfonate functional groups, or polytetrafluoroethylene particles modified on their surfaces with fluorinated copolymer having acid type functional groups (GB No. 2,064,586A). Such binder can be used in an amount of about from 10 to 50% by wt. of the non-electrode layer or of the electrocatalyst composition layer.

Composite structures having non-electrode layers and/or electrocatalyst composition layers thereon can be made by various techniques known in the art, which include preparation of a decal which is then pressed onto the membrane surface, application of a slurry in a liquid composition (e.g., dispersion or solution) of the binder followed by drying, screen or gravure printing of compositions in paste form, hot pressing of powders distributed on the membrane surface, and other methods as set forth in GB No. 2,064,586A. Such structures can be made by applying the indicated layers onto membranes in melt-fabricable form, and by some of the methods onto membranes in ion-exchange form; the polymeric component of the resulting structures when in melt-fabricable form can be hydrolyzed in known manner to the ion-exchange form.

Non-electrode layers and electrocatalyst composition layers can be used in combination in various ways on a membrane. For example, a surface of a membrane can be modified with a non-electrode layer, and an electrocatalyst composition layer disposed over the latter. It is also possible to place on a membrane a layer containing both an electrocatalyst and a conductive non-electrode material, e.g. a metal powder which has a higher overvoltage than the electrocatalyst, combined into a single layer with a binder. One preferred type of membrane is that which carries a cathodic electrocatalyst composition on one surface thereof, and a non-electrode layer on the opposite surface thereof.

Membranes which carry thereon one or more electrocatalyst layers, or one or more non-electrode layers, or combinations thereof, can be employed in an electrochemical cell in a narrow-gap or zero-gap configuration as described above.

The membranes of this invention, after degradation of the reinforcing web, have another surprising advantage. They are more resistant to the deleterious effect of $Na_2SO_4$ in the brine than corresponding membranes containing carboxylic or carboxylic and sulfonyl ion exchange resins and a perfluorocarbon reinforcing web, but never having contained a degradable reinforcing web. The control membranes suffer deleterious effects when the brine contains 30 g/l or even as little as 10 g/l. $Na_2SO_4$. The current efficiency deteriorates somewhat after a few weeks and $Na_2SO_4$ crystals may appear in the cathode surface of the laminar structure, especially close to the perfluorocarbon threads. With the membrane of the present invention, these deleterious effects are not observed.

The invention is further illustrated in the following specific examples:

EXAMPLE 1

A reinforced cationic ion exchange membrane was prepared by thermally bonding together two polymeric layers. A cathode surface layer was used consisting of 51 microns (2 mils) of a copolymer of tetrafluoroethylene (TFE) and methyl perfluoro (4,7-dioxa-5-methyl-8-noneate) (EVE) and having an equivalent weight of 1080. An anode surface layer was used consisting of 127 microns (5 mils) of a copolymer of TFE and perfluoro (3,6-dioxa-4-methyl-7-octenesulfonyl fluoride) (PSEPVE) and having an equivalent weight of 1100. The anode layer was impregnated into 102 microns (4 mils) of two-ply facial tissue paper.

The laminate was made in two steps using a heated platen press. In the first step the TFE/PSEPVE copolymer was pressed into the tissue paper at 270° C. and 3.23 MPa (469 psig) for 1 min. In the second step the TFE/EVE layer was thermally bonded at 250° C. at 1.1 MPa (156 psig) for 1 min. The resulting laminate was hydrolyzed in a bath containing 30% dimethyl sulfoxide (DMSO) and 11% potassium hydroxide (KOH) for 20 minutes at 90° C. The resulting construction was leak-free as determined by a vacuum leak checker. The laminate was treated with a hot solution of 5% sodium hypochlorite (NaOCl) where it was found that the paper was leached out after about 1 hour.

A portion of the laminate so treated was mounted wet in a laboratory chloralkali cell having an active area of 45 $cm^2$ between a dimensionally stable anode and a mild steel expanded metal cathode. The cell was operated at 80° C. with a current density of 3.1 $KA/m^2$ The anolyte salt content was held at 200 gpl. Water was added to the catholyte to maintain the concentration of the caustic produced at 32±1%.

After 6 days on line the cell was performing well at 3.70 volts and 95.1% current efficiency.

EXAMPLE 2

If the following procedure is carried out, the indicated results will be expected.

A cationic ion exchange membrane containing a temporary reinforcement is prepared by thermally bonding together the following layers in the order specified.

A. A cathode surface layer consisting of a 25 micron (1 mil) film of TFE/EVE having an equivalent weight of 1080.

B. A 76 micron (3 mil) layer of TFE/PSEPVE having an equivalent weight of 1100.

C. A reinforcing cloth having a thickness of 71.1 (2.8 mils) consisting of 50 denier rayon fiber with a warp and fill thread count of 29.5 threads/cm (75 threads/in).

D. An anode surface layer consisting of 25 (1 mil) of a TFE/PSEPVE copolymer having an equivalent weight of 1100. This construction is thermally bonded and hydrolyzed. The resulting laminate shows improved tear resistance over a nonreinforced construction of similar thickness. If tested in a laboratory cell under the conditions of Example 1, except that the cell is operated at 90° C, after 7 days of operation the membrane is expected to perform well at 3.63 volts and 95% current efficiency. After 7 days of operation, removal and examination of the membrane will indicate a substantial total dissolution of the rayon fibers, leaving a pattern of channels where the fabric had been.

We claim:

1. In a process for the continous production of alkali metal hydroxide which comprises continuously providing an aqueous alkali metal halide solution to the anode compartment of an electrolytic cell having an anode, a cathode, and a cation exchange membrane separating the anode and the cathode; electrolyzing the solution; and continuously removing alkali metal hydroxide solution, hydrogen, and halogen from the electrolytic cell, the improvement wherein the cation exchange membrane consists essentially of: (a) at least one layer of fluorinated polymer having side chains containing sulfonyl and/or carboxyl groups and (b) a reinforcing web embedded in the fluorinated polymer layer, wherein the entire reinforcing web is degradable by hypochlorite.

2. In an electrolytic cell having an anode, a cathode, and a cation exchange membrane separating the anode and the cathode, the improvement wherein the cation exchange membrane consists essentially of: (a) at least one layer of fluorinated polymer having side chains containing sulfonyl and/or carboxyl groups and (b) a reinforcing web embedded in the fluorinated polymer layer, wherein the entire reinforcing web is degradable by hypochlorite.

3. An electrolytic cell of claim 2 wherein the gap between the electrodes is no greater than about 3 mm.

4. A cation exchange membrane of claim 1 further comprising a gas- and liquid-permeable porous layer of electrocatalyst composition on at least one surface thereof.

5. A cation exchange membrane of claim 1 further comprising a gas- and liquid-permeable porous non-electrode layer on at least one surface thereof.

6. A process of claim 1 wherein the cationic ion exchange membrane has a gas- and liquid-permeable porous layer of electrocatalyst composition on at least one surface.

7. A process of claim 1 wherein the cationic ion-exchange membrane has a gas- and liquid-permeable porous non-electrode layer on at least one surface.

8. A process of claim 1 wherein the cationic ion-exchange membrane includes at least one gas- and liquid-permeable porous layer selected from electrocatalyst composition and non-electrode material.

9. A fluorocarbon cation exchange membrane consisting essentially of: (a) at least one layer of fluorinated polymer having side chains containing sulfonyl and/or carboxyl groups and (b) a reinforcing web embedded in the layer of fluorinated polymer, wherein the entire reinforcing web is degradable by hypochlorite.

10. A cation exchange membrane of claim 9 wherein the reinforcing web has a thickness of about from 25 to 125 microns.

11. A cation exchange membrane of claim 9 wherein the reinforcing web is nonwoven.

12. A cation exchange membrane of claim 11 wherein the reinforcing web consists essentially of tissue paper.

13. A cation exchange membrane of claim 9 wherein the reinforcing web is a woven fabric.

14. A cation exchange membrane of claim 13 wherein the woven fabric is rayon.

15. A cation exchange membrane of claim 9 wherein the fluorinated polymer is a laminar structure comprising a perfluorosulfonic acid polymer bonded to a perfluorocarboxylic acid polymer and the reinforcing web is embedded in the perfluorosulfonic acid polymer.

16. A cation exchange membrane of claim 15 wherein the perfluorosulfonic acid polymer has an equivalent weight of about from 1000 to 1600 and the perfluorocarboxylic acid polymer has an equivalent weight of about from 500 to 1500.

* * * * *